United States Patent [19]

Haga et al.

[11] Patent Number: 4,992,357

[45] Date of Patent: Feb. 12, 1991

[54] SILVER HALIDE COLOR PHOTOGRAPHIC LIGHT-SENSITIVE MATERIAL

[75] Inventors: Yoshihiro Haga; Hiroshi Shimazaki; Atsuo Ezaki; Yoshiro Shigetomi, all of Hino, Japan

[73] Assignee: Konica Corporation, Tokyo, Japan

[21] Appl. No.: 375,388

[22] Filed: Jul. 3, 1989

[30] Foreign Application Priority Data

Jul. 7, 1988 [JP] Japan ..... 63-170127

[51] Int. Cl.[5] ..... G03C 1/46

[52] U.S. Cl. ..... 430/504; 430/537; 430/539; 430/950; 430/359

[58] Field of Search ..... 430/537, 539, 503, 950, 430/504, 359

[56] References Cited

U.S. PATENT DOCUMENTS

| | | | |
|---|---|---|---|
| 4,142,894 | 3/1979 | Hori et al. | 430/950 |
| 4,287,299 | 9/1981 | Himmelmann et al. | 430/537 |
| 4,447,525 | 5/1984 | Vallarino et al. | 430/539 |
| 4,524,131 | 6/1985 | Himmelmann et al. | 430/539 |
| 4,603,102 | 7/1986 | Himmelmann et al. | 430/539 |
| 4,833,069 | 5/1989 | Hamada et al. | 430/504 |

*Primary Examiner*—Paul R. Michl
*Assistant Examiner*—Thomas R. Neville
*Attorney, Agent, or Firm*—Jordan B. Bierman

[57] ABSTRACT

A silver halide color photographic light-sensitive material having an excellent adhesion resistance and capable of preventing deterioration of quality of processed images is disclosed. The light-sensitive material having a support and provided thereon, the photographic component layers including each at least one red-sensitive layer comprising at least a masking cyan coupler, green-sensitive layer comprising at least a masking magenta coupler, and blue-sensitive layer, is characterized by that:

A. an uppermost layer of said photographic component layers comprises an alkali-soluble matting agent, B. a total amount of coated silver is 15 to 45 mg/dm$^2$.

14 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material, and more particularly to a silver halide color photographic light-sensitive material having an excellent adhesion resistance and capable of preventing deterioration of quality of developed images.

BACKGROUND OF THE INVENTION

For an effective use of a valuable resource of silver which is a raw material of silver halide grains used in color photographic light-sensitive materials, it has been required to minimize an amount of coated silver.

However, there have been problems in a color photographic light-sensitive material coated with a small amount of silver, that an image quality is deteriorated or that an adhesion resistance of a surface thereof is deteriorated because of an unknown reason, which results in liability to causing adhesion problems in the courses of manufacturing, storing for processing, and photographing.

SUMMARY OF THE INVENTION

It is a primary object of the invention to provide a silver halide color photographic light-sensitive material having an excellent adhesion resistance and capable of preventing deterioration of quality of developed images.

The above-mentioned object of the invention can be accomplished with a silver halide color photographic light-sensitive material having a support and provided thereon the photographic component layers including each at least one red-sensitive layer comprising at least a masking cyan coupler, green-sensitive layer comprising at least a masking magenta coupler and blue-sensitive layer, wherein the total amount of coated silver is 15 to 45 mg/dm$^2$ and an uppermost layer of the photographic component layers contains an alkali-soluble matting agent.

DETAILED DESCRIPTION OF THE INVENTION

In the invention, a total coated silver amount contained in a color photographic light-sensitive material is 15 to 45 mg/dm$^2$, and preferably 20 to 40 mg/dm$^2$, wherein the total coated silver amount is a total amount of all silver compounds converted to silver including silver halide and colloidal silver.

Silver halide grains applicable to a color photographic light-sensitive material are generally prepared from an aqueous silver nitrate solution and an aqueous alkali halide solution. For an effective use of a valuable resource of silver, the researches and studies have been well in progress so as to minimize an amount of silver coated on a silver halide color photographic light-sensitive material. In a color negative film of the invention, however, it is difficult to limit a total silver amount to less than 15 mg/dm$^2$, from the viewpoints of a gradation and color density of a light-sensitive material.

In invention, each at least one red light-sensitive layer, one green light-sensitive layer and one blue light-sensitive layer, provided on a support may be comprised of any number of layers, preferably 1 to 5 layers, and more preferably 2 or 3 layers. It is further allowed to interpose a substantially insensitive layer between the respective light-sensitive layers.

In the invention, a red-sensitive layer contains a cyan coupler for masking and the green-sensitive layer contains magenta coupler for masking.

The masking couplers are to improve lowering of color reproducibility caused by a secondary absorption of magenta and cyan dyes. Such masking couplers include, for example, a coupler of which active site is substituted with a masking dye; a coupler of which active site is substituted with an azo group and utilized as a part of a masking dye; the above-mentioned two types of couplers are called a colored coupler. They further include those described in Japanese Patent Publication Open to Public Inspection (hereinafter called Japanese Patent O.P.I. Publication) No. 63-75747/1988, in which a leuco compound of a masking dye substitutes an active site of a coupler and is resultingly removed from a photographic light-sensitive material upon a reaction of the coupler with an oxidized product of a color developing agent, leuco compound is converted to a masking dye in an oxidation process such as a bleaching process with potassium ferrocyanide; those described in Japanese Patent O.P.I. Publication No. 62-145243/1987, in which a spectral absorption peak of a masking dye substituting an active site of a coupler is temporarily shifted by a protective group to a shorter wavelength; and so forth. In the invention, any of these masking couplers can be used.

When using a colored cyan coupler in the invention, the compound represented by the following Formula A is preferably used;

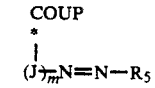

Formula A wherein COUP represents a cyan coupler residue; * represents a coupling site of a cyan coupler; J represents a divalent linking group; m is an integer of 0 or 1; and $R_5$ represents an aryl group.

The cyan coupler residue represented by COUP includes those of the phenol and naphthol types, and more preferably those of a naphthol type.

The preferable divalent linking group represented by J is preferably represented by the following Formula B;

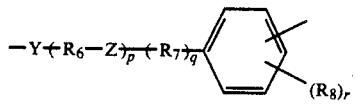

Formula B wherein Y represents -O-, -S-,

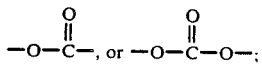

$R_6$ represents an alkylene group having 1 to 4 carbon atoms or an arylene group; $R_7$ represents an alkylene group having 1 to 4 carbon atoms; provided the alkylene groups represented by $R_6$ and $R_7$ may be substituted by an alkyl group, a carboxy group, a hydroxy group and a sulfo group; Z represents

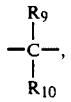

—O—, —S—, —SO—, —$SO_2$—, —$SO_2NH$—, —CONH—, —COO—, —NHCO—, —$NHSO_2$— or —OCO—; $R_9$ and $R_{10}$ represent each an alkyl group or an aryl group;

$R_8$ represents a hydrogen atom, an alkyl group, an aryl group, a heterocyclic group, a hydroxy group, a cyano group, a nitro group, a sulfonyl group, an alkoxy group, an aryloxy group, a carboxy group, a sulfo group, a halogen atom, a an group, a sulfonamide group, a carbamoyl group, an alkoxycarbonyl group, or a sulfamoyl group;

p is an integer; q is an integer of 0 or 1; and r is an integer of 1 to 4; provided, when p is not less than 2, $R_6$ and Z may be same or different, respectively; and when r is not less than 2, $R_8$s may be same or different.

When m is zero, the aryl group represented by $R_5$ is preferably a phenyl group or a naphthyl group including substituted one.

The substituents thereof include a halogen atom, an alkyl group, an alkoxy group, an aryloxy group, a hydroxy group, an acyloxy group, a carboxyl group, an alkoxycarbonyl group, an aryloxycarbonyl group, a mercapto group, an alkylthio group, an arylthio group, an alkylsulfonyl group, an arylsulfonyl group, an acyl group, an acylamino group, a sulfonamide group, a carbamoyl group, a sulfamoyl group, and so forth.

When m is 1, the aryl group represented by $R_5$ is preferably the naphthol group represented by the following Formula C;

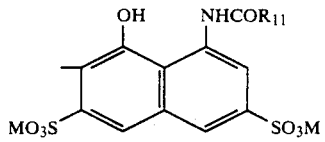

Formula C wherein $R_{11}$ represents a linear or branched alkyl group having 1 to 4 carbon atoms such as a methyl group, an ethyl group, a propyl group, an isopropyl group, a butyl group, a s-butyl group, a t-butyl group, and so forth; and M represents a photographically inert cation such as a hydrogen atom, an alkali metal cation such as a sodium atom and a potassium atom, ammonium, methyl ammonium, ethyl ammonium, diethylammonium, triethyl ammonium, ethanol ammonium, diethanol ammonium, pyridinium, piperidium, anilinium, toluidinium, p-nitroanilinium, anisidinium, and so forth.

The colored couplers represented by Formula A are exemplified below. It is, however, to be understood that the colored couplers shall not be limited thereto.

CC-1

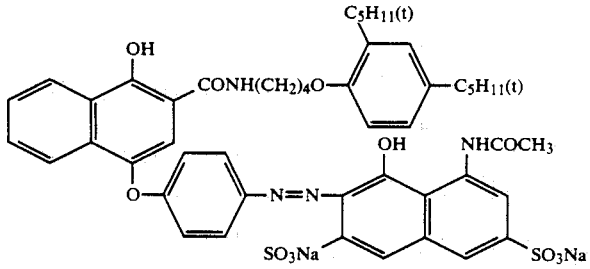

CC-2

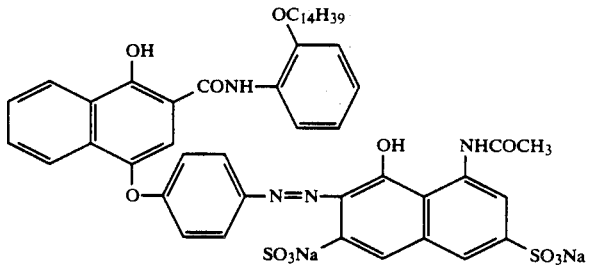

CC-3

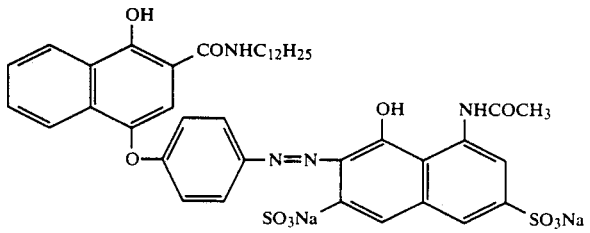

-continued
CC-4
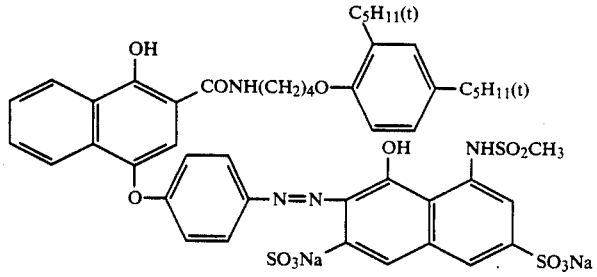
CC-5
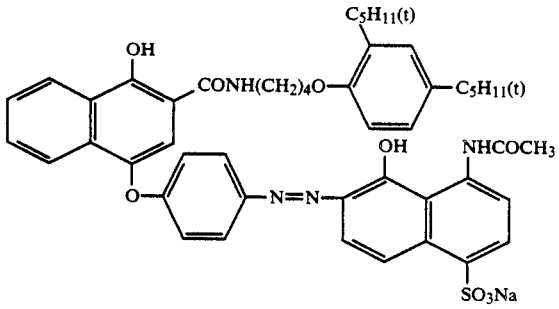
CC-6
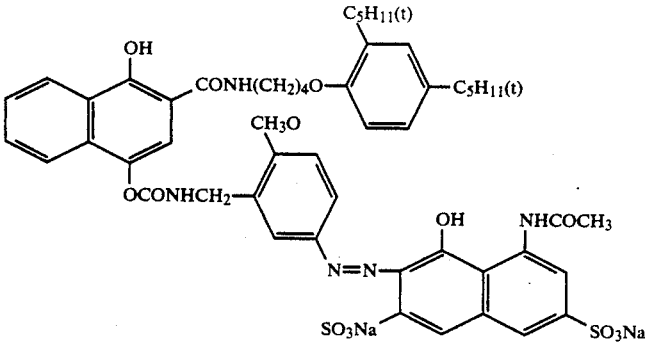
CC-7
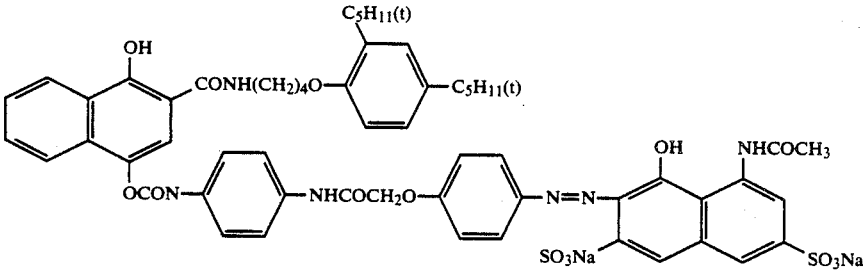
CC-8
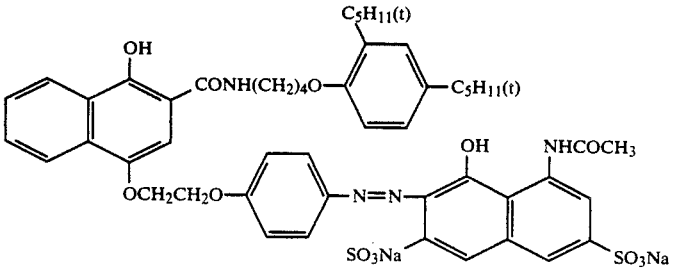

-continued
CC-9
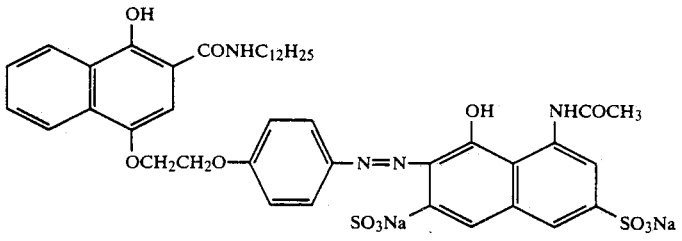
CC-10
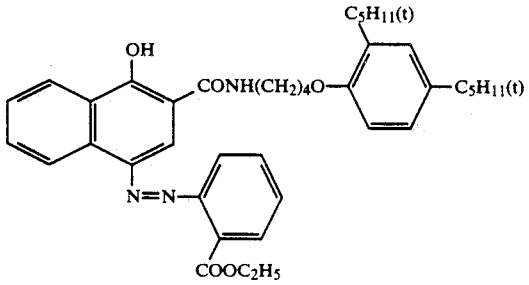
CC-11
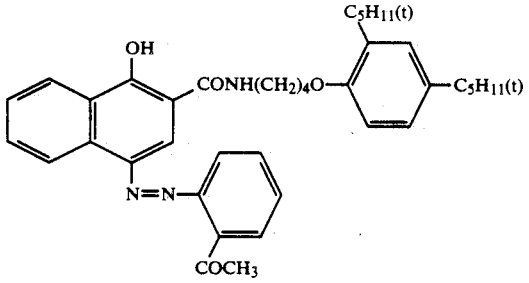
CC-12
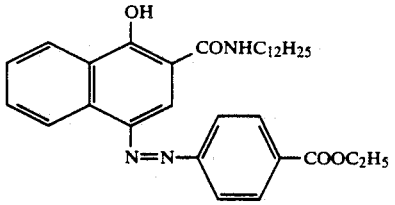
CC-13
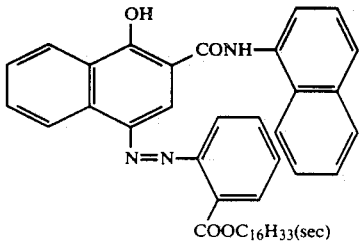

-continued

CC-14

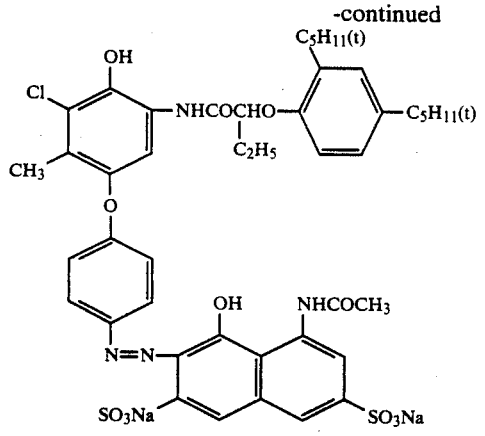

The above-given compounds can be synthesized in the methods described in. Japanese Patent O.P.I. Publication Nos. 50-123341/1975, 55-65957/1980, and 56-94347/1981; Japanese patent Examined Publication Nos. 42-11304/1967, 44-32461/1969, 48-17899/1975, and 53-34733/1978; U.S. Pat. No. 3,034,892; British patent No. 1,084,480; and so forth.

In the invention, the colored cyan couplers are used in a range of 5 to 95 mol % to the whole cyan color developing couplers.

When using a colored magenta coupler in the invention, the compound represented by the following Formula III is preferably be used.

Formula III $Cp-N=N-R_1$ wherein Cp represents a magenta coupler residue, provided an azo group bonds to an active site of the magenta coupler; and $R_1$ represents an aryl group including one having a substituent.

The magenta coupler residue represented by Cp is preferably a coupler residue generated from a 5-pyrazolone or pyrazolotriazole type magenta coupler, and more preferably those represented by the following Formula IV;

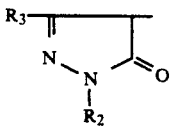

Formula IV wherein $R_2$ represents an aryl group; $R_3$ represents an acylamino group, an anilino group, a ureido group, or a carbamoyl group; provided $R_2$ and $R_3$ each may have a substituent.

The aryl group represented by $R_2$ is preferably a phenyl group. The substituents of $R_2$ include a halogen atom such as an atom of fluorine, chlorine, bromine or the like; an alkyl group such as a group of methyl, ethyl or the like; an alkoxy group such as a group of methoxy, ethoxy or the like; an aryloxy group such as a group of phenyloxy, naphthyloxy or the like; an acylamino group such as a group of benzamide, α-(2,4-di-t-amylphenoxy)butylamide or the like; a sulfonylamino group such as a group of benzenesulfonamide, n-hexadecanesulfonamide or the like; a sulfamoyl group such as a group of methylsulfamoyl, phenylsulfamoyl or the like; a carbamoyl group such as a group of n-butylcarbamoyl, phenylcarbamoyl or the like; a sulfonyl group such as a group of methylsulfonyl, n-dodecylsulfonyl, benzenesulfonyl or the like; an acyloxy group; an ester group; a carboxy group; a sulfo group; a cyano group; a nitro group; and so forth.

Further, the typical examples of $R_2$ include phenyl, 2,4,6-trichlorophenyl, pentachlorophenyl, pentafluorophenyl, 2,4,6-trimethylphenyl, 2-chloro-4,6-dimethylphenyl, 2,6-dichloro-4-methylphenyl, 2,4-dichloro-6-methylphenyl, 2,4-dichloro-6-methoxyphenyl, 2,6-dichloro-4-methoxyphenyl, 2,6-dichloro 4-[α-(2,4-di-t-amylphenoxy)acetamide]phenyl, and so forth.

The acylamino group represented by $R_3$ includes pivaloylamino, n-tetradecanamide, α-(3-pentadecylphenoxy)butylamide, 3-[α-(2,4-di-t-amylphenoxy)acetamide]benzamide, benzamide, 3-acetamidebenzamide, 3-(3-n-dodecylsuccinimido)benzamide, 3-(4-n-dodecyloxybenzenesulfonamide)benzamide, and so forth.

The anilino group represented by $R_3$ includes 2-chloranilino, 2,4-dichloranilino, 2,4-dichloro-5-methoxyanilino, 4-cyanoanilino, 2-chloro-5-[α-(2,4-di-t-amylphenoxy)butylamide]anilino, 2-chloro-5-(3-octadecenylsuccinimido)anilino, 2-chloro-5-n-tetradecaneamideanilino, 2-chloro-5-[α-(3-t-butyl-4-hydroxyphenoxy)tetradecaneamide]anilino, 2-chloro-5-n-hexandecanesulfonamideanilino, and so forth.

The ureido group represented by $R_3$ includes methylureido, phenylureido, 3-[α-(2,4.di-t-amylphenoxy)-butylamide]phenylureido, and so forth.

The carbamoyl group represented by $R_3$ includes n-tetradecylcarbamoyl, phenylcarbamoyl, 3-[α-(2,4-di-t-amylphenoxy)acetoamide]phenylcarbamoyl, and so forth.

The aryl group represented by $R_1$ is preferably a phenyl or naphthyl group.

The substituents of $R_1$ include a halogen atom, an alkyl group, an alkoxy group, an aryloxy group, a hydroxy group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group, a sulfamoyl group, and so forth.

Among these substituents, the particularly preferable ones are, an alkyl group, a hydroxy group, an alkoxy group, and an acylamino group.

The colored magenta couplers represented by Formula III are exemplified below. It is, however, to be understood that they shall not be limited thereto.

CM-1
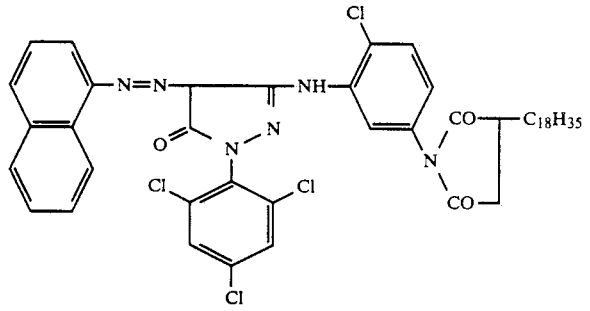
CM-2
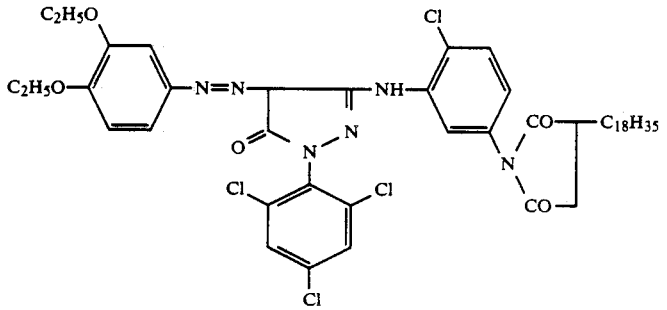
CM-3
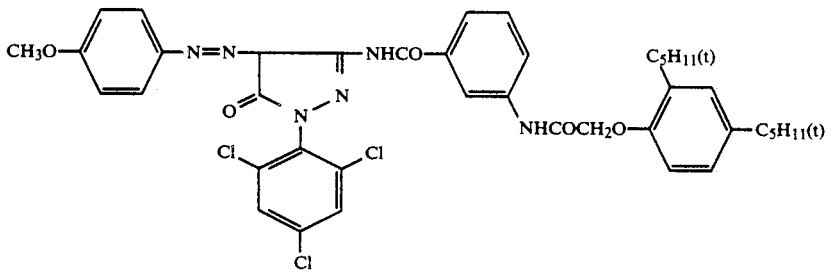
CM-4
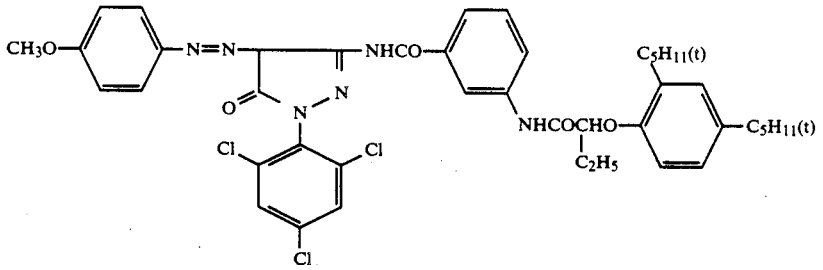
CM-5
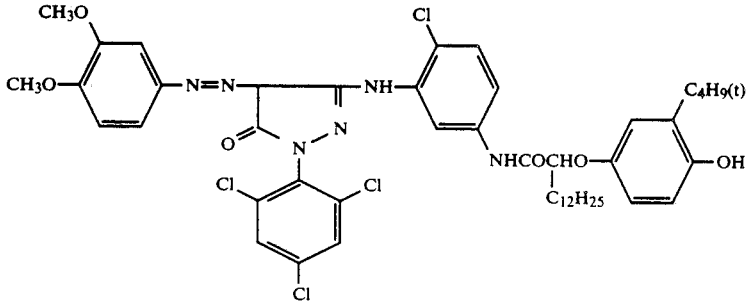

-continued
CM-6
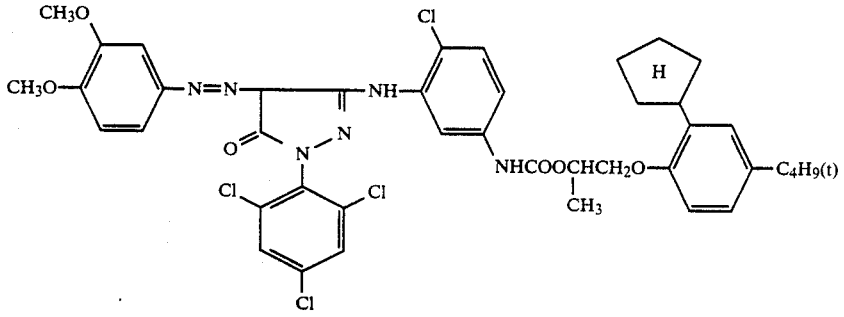
CM-7
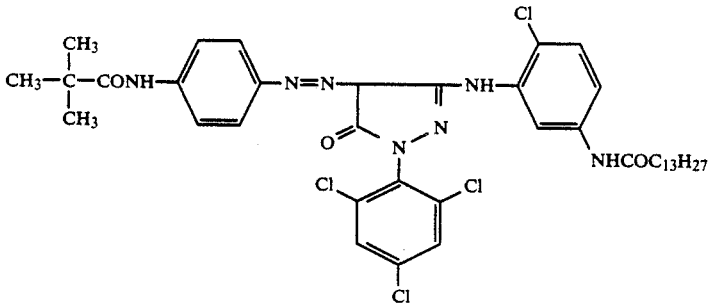
CM-8
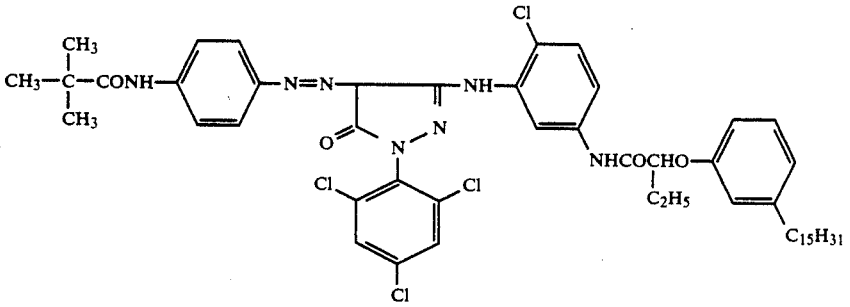
CM-9
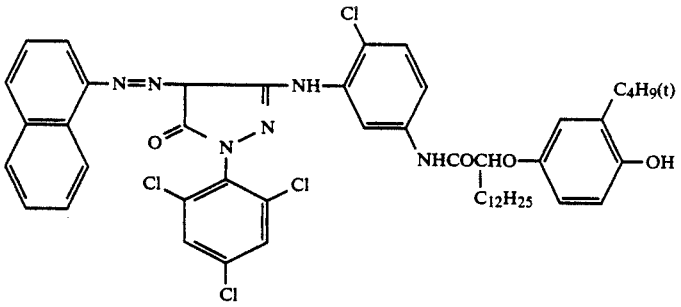
CM-10
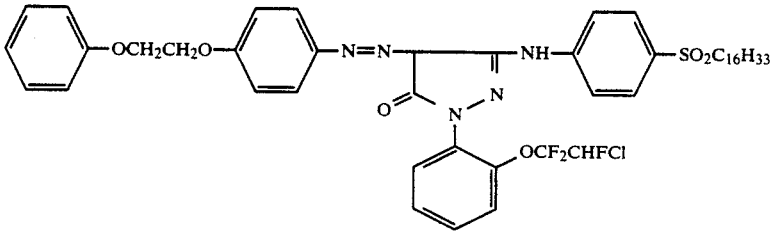

-continued
CM-11
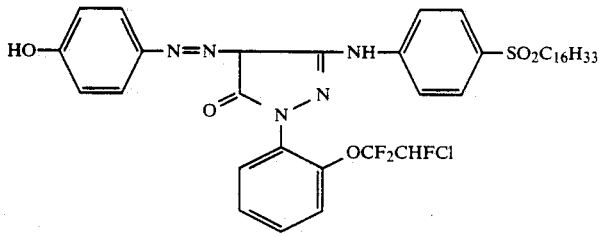
CM-12
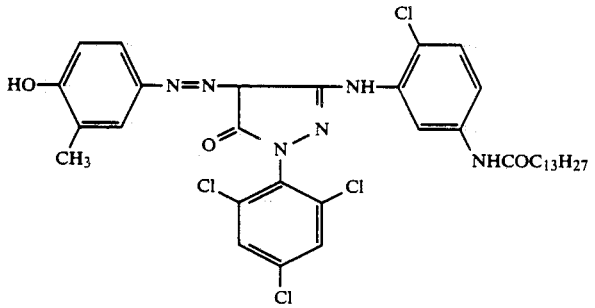
CM-13
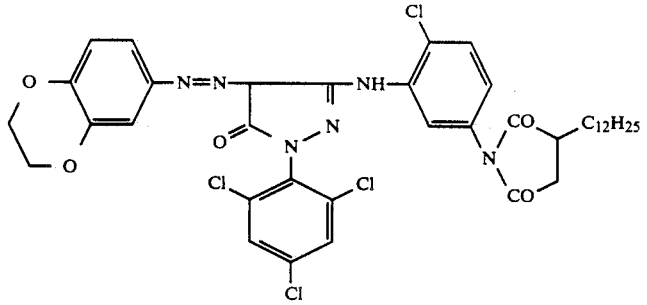
CM-14
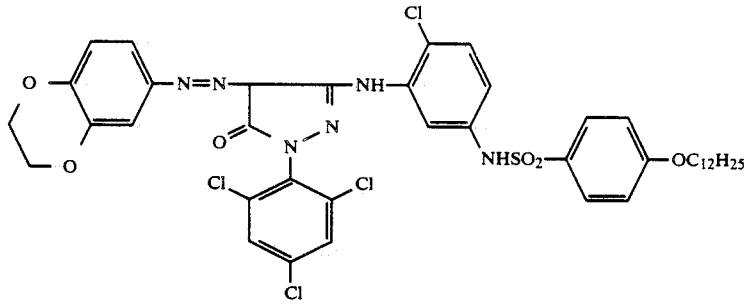
CM-15
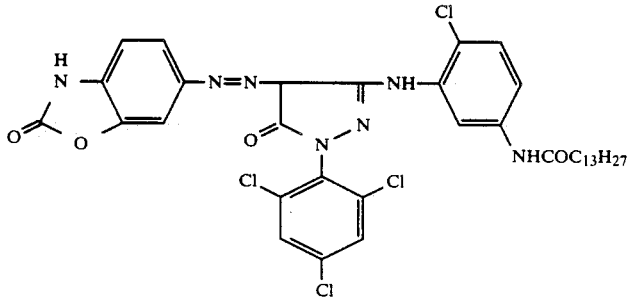

-continued
CM-16
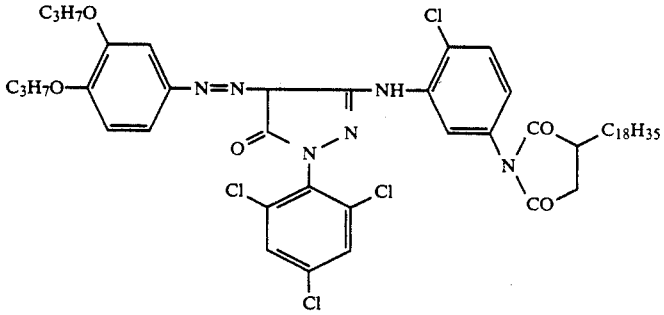
CM-17
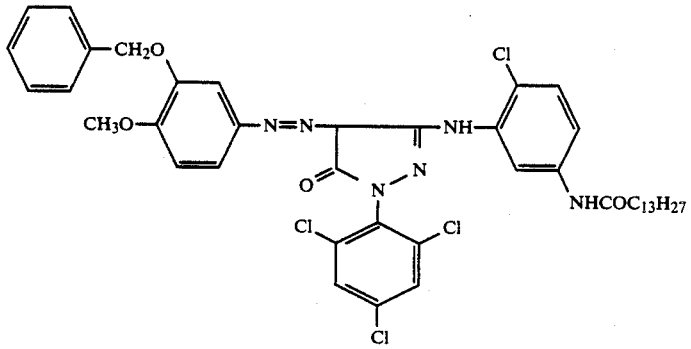
CM-18
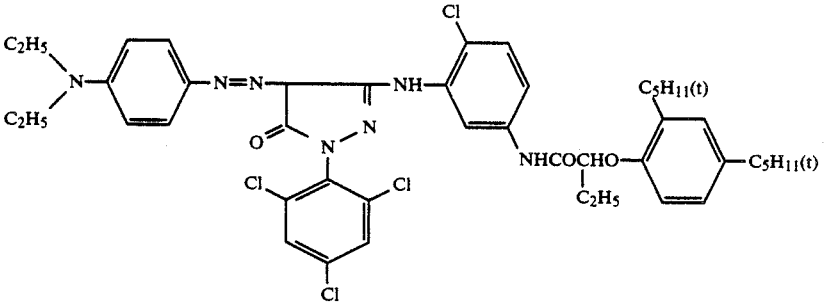
CM-19
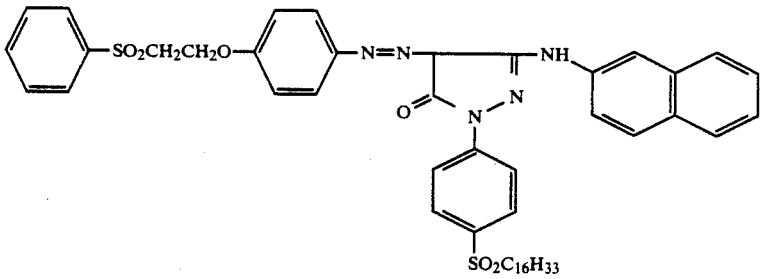
CM-20
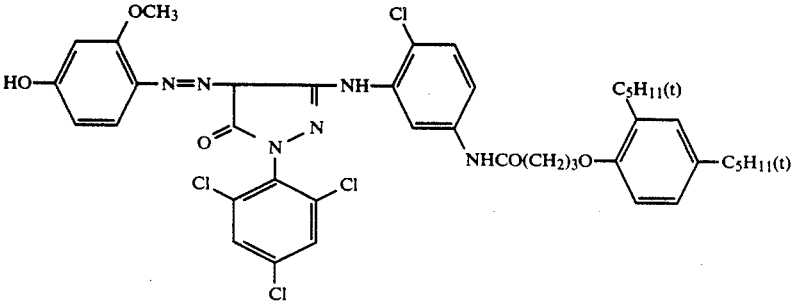

-continued

CM-21

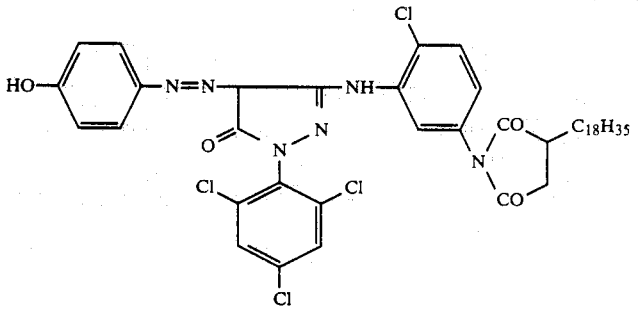

CM-22

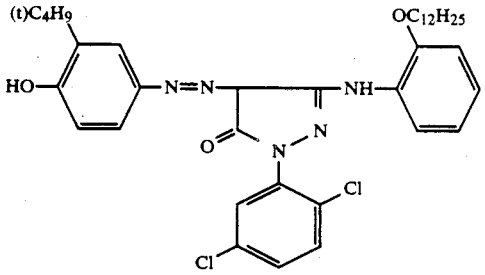

CM-23

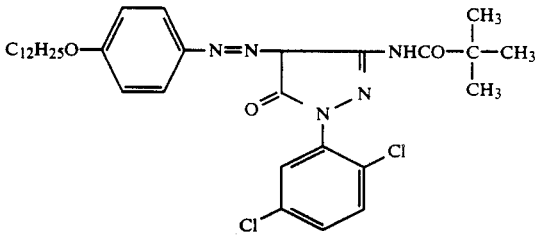

CM-24

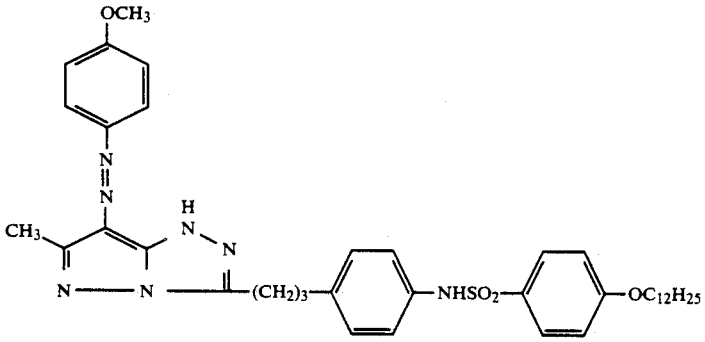

The colored magenta couplers relating to the invention can be synthesized according to the methods described in Japanese Patent O.P.I. Publication Nos. 49-123625/1974, 49-131448/1974, 52-42121/1977, 52-102723/1977, 54-52532/1979 and 58-172647/1983; U.S. Pat. Nos. 2,763,552, 2,801,171 and 3,519,429; and so forth.

In the invention, the colored magenta couplers are used in a range of 5 to 95 mol % to the whole magenta couplers.

Any of alkali soluble matting agents can be used in the invention, provided they is soluble in any ordinary type weakly alkaline processing solution such as a developer. These matting agents include the particles of the following polymers.

1. Copolymer of alkyl methacrylate and methacrylic acid, acrylic acid or itaconic acid,
2. Copolymer of alkyl methacrylate and maleic monoester and monoamide,
3. Copolymer of styrene and $\alpha$, $\beta$-unsaturated mono- or di- carboxylic acid, or dicarboxylic monoester or monoamide,
4. Graft polymer of a maleic anhydride, $\alpha$-oleffin copolymer and methacrylic acid or methyl methacrylate,
5. Dicarboxylic acid mono-ester of a cellulose derivative, such as phthalate and hexahydrophthalate of methyl cellulose hydroxyethyl cellulose or hydroxypropylomethyl cellulose.

Generally, a monomer is selectively used in such an amount as that the polymer grains are insoluble to water at pH of not higher than 5 and are soluble to water at pH of not lower than 7.

Usually, the polymer grains are dispersed in a coating solution and coated on a photographic light-sensitive material in a proportion of 10 to 500 mg/m$^2$, particularly 20 to 300 mg/m$^2$.

A grain size of the matting agent relating to the invention is 0.5 to 10 μ, and preferably 1 to 6 u.

Matting agents of the invention are exemplified below.

Mat 1: MMA - MAA, 50:50 copolymer grains, a grain size: 2.5 μ

Mat 2: MMA - MAA, 60:40 copolymer grains, a grain size: 4.5 μ

Mat 3: EMA - MMA - MAA, 30:30:40 copolymer grains, a grain size: 3.6 μ

Mat 4: Hydroxypropylmethyl cellulose hexahydrophthalate, a grain size: 2.0 μ

Mat 5: MMA - MAA, 65:35 copolymer grains, a grain size: 3.0 μ

MMA: Methyl methacrylate,

MAA: Methacrylic acid,

EMA: Ethylmethacrylate.

Any ordinary types of silver halide emulsions can be used for the light-sensitive materials of the invention.

The emulsions are chemically sensitized in the ordinary methods and spectrally sensitized to the desired wavelength regions by sensitizing dyes.

It is allowed to add an antifoggant, a stabilizer, and so forth to the silver halide emulsions. Gelatin is preferably used as a binder for the emulsions.

An emulsion layer and other hydrophilic colloidal layers may be hardened and contain a plasticizer, a latex, and so forth.

A color light-sensitive material of the invention may further comprise a competitive coupler having a color correction function, or a compound capable of releasing a photographically useful fragments upon a coupling reaction with an oxidized product of a developing agent, such as a development accelerator, a bleach accelerator, a developing agent, a silver halide solvent, an image toning agent, a hardener, a fogging agent, an antifoggant, a chemical sensitizer, a spectral sensitizer and a desentizier, The light-sensitive material of the invention may be provided with such auxiliary layers as a filter layer, an antihalation layer, an antiirradiation layer and so forth.

The light-sensitive materials of the invention may comprise a formalin scavenger, a fluorescent whitening agent, a lubricant, an image stabilizer, a surface active agent, an antifoggant, a development accelerator, a development retarder, a bleach accelerator, and so forth.

The supports applicable to the invention include paper laminated with polyethylene, a polyethyleneterephthalate film, a baryta paper, a triacetate cellulose film and so forth.

A color light-sensitive material of the invention are subjected to conventional photographic processing after exposing to obtain a dye image. Also, the light-sensitive material can be processed with a color developer at a replenishing amount of not more than 900 ml/m$^2$ of the light-sensitive material.

EXAMPLES

The invention are more detailed with reference to the following examples. It is, however, to be understood that the invention shall not be limited thereto.

EXAMPLE 1

The groups consisting of photographic component layers 1 to 5, 6 to 9 and 10 to 13 each having the following compositions were coated on a support of a triacetyl cellulose film, separately by group in order from the support to prepare a multilayered color photographic sample 1.

The coated amounts of silver halides and colloidal hilver are expressed in terms of g/m$^2$ converted to silver, those of couplers, additives and gelatin in terms of g/m$^2$, and those of sensitizing dyes in terms of mole per mole of silver halide.

The above-mentioned coating units are applied to every example given below.

| Sample-101 (comparison) | |
|---|---|
| **Layer 1: Antihalation layer (HC-1)** | |
| Black colloidal silver | 0.20 |
| UV absorbent. UV-1 | 0.20 |
| High boiling solvent, Oil-1 | 0.10 |
| Gelatin | 1.5 |
| **Layer 2: Interlayer (IL-1)** | |
| UV absorbent, UV-1 | 0.01 |
| High boiling solvent. Oil-1 | 0.01 |
| Gelatin | 1.5 |
| **Layer 3: Low red-sensitive emulsion layer (RL)** | |
| Silver bromoiodide emulsion, Em-1-(1) | 0.3 |
| Silver bromoiodide emulsion, Em-2-(1) | 0.3 |
| Sensitizing dye, SD-1 | $2.5 \times 10^{-4}$ |
| Sensitizing dye, SD-2 | $2.5 \times 10^{-4}$ |
| Sensitizing dye, SD-3 | $0.5 \times 10^{-4}$ |
| Cyan coupler, C-1 | 0.59 |
| Cyan coupler, C-2 | 0.03 |
| Colored cyan coupler, CC-1 | 0.03 |
| DIR compound, D-1 | 0.001 |
| High boiling solvent, Oil-1 | 0.293 |
| Gelatin | 1.0 |
| **Layer 4: High red-sensitive emulsion layer (RH)** | |
| Silver bromoiodide emulsion, Em-3-(1) | 0.6 |
| Sensitizing dye, SD-1 | $2.0 \times 10^{-4}$ |
| Sensitizing dye, SD-2 | $2.0 \times 10^{-4}$ |
| Sensitizing dye, SD-3 | $0.1 \times 10^{-4}$ |
| Cyan coupler, C-1 | 0.23 |
| Cyan coupler, C-2 | 0.012 |
| Colored cyan Coupler, CC-1 | 0.012 |
| DIR compound, D-1 | 0.04 |
| High boiling solvent, Oil-1 | 0.2 |
| Gelatin | 0.6 |
| **Layer 5: Interlayer (IL-2)** | |
| Polymethyl methacrylate, an average grain size: 3μ | 0.05 |
| Gelatin | 0.5 |
| **Layer 6: Low green-sensitive emulsion layer (GL)** | |
| Silver bromoiodide emulsion, Em-1-(1) | 0.6 |
| Sensitizing dye, SD-4 | $5 \times 10^{-4}$ |
| Sensitizing dye, SD-5 | $1 \times 10^{-4}$ |
| Magenta coupler, M-1 | 0.45 |
| Colored magenta coupler, CM-1 | 0.01 |
| DIR compound, D-3 | 0.02 |
| DIR compound, D-4 | 0.02 |
| High boiling solvent, Oil-1 | 0.28 |
| Gelatin | 1.0 |
| **Layer 7: Interlayer (IL-3)** | |
| Gelatin | 0.8 |
| **Layer 8: High green-sensitive emulsion layer (GH)** | |
| Silver bromoiodide emulsion, Em-3-(1) | 0.8 |
| Sensitizing dye, SD-6 | $1.5 \times 10^{-4}$ |
| Sensitizing dye, SD-7 | $2.5 \times 10^{-4}$ |
| Sensitizing dye, SD-8 | $0.5 \times 10^{-4}$ |
| Magenta coupler, M-2 | 0.03 |
| Magenta coupler, M-3 | 0.08 |
| Colored magenta coupler, CM-1 | 0.04 |
| DIR Compound, D-3 | 0.008 |
| High boiling solvent, Oil-3 | 0.4 |
| Gelatin | 1.0 |
| **Layer 9: Yellow filter layer (YC)** | |
| Yellow colloidal silver | 0.1 |
| Anti-staining agent, SC-1 | 0.1 |
| High boiling solvent, Oil-3 | 0.1 |
| Polymethyl methacrylate, an average grain size: 3μ | 0.05 |
| Gelatin | 0.8 |
| **Layer 10: Low blue-sensitive emulsion layer (BL)** | |

-continued

| Sample-101 (comparison) | |
|---|---|
| Silver bromoiodide emulsion, Em-1-(1) | 0.15 |
| Silver bromoiodide emulsion, Em-2-(1) | 0.15 |
| Sensitizing dye, SD-10 | $7 \times 10^{-4}$ |
| Yellow coupler, Y-1 | 0.7 |
| Yellow coupler, Y-2 | 0.15 |
| DIR compound, D-2 | 0.15 |
| High boiling solvent, Oil-3 | 0.4 |
| Gelatin | 1.0 |
| Layer 11: High blue-sensitive emulsion layer (BH) | |
| Silver emulsion, Em-4-(1) | 0.15 |
| Silver emulsion, Em-1-(1) | 0.15 |
| Sensitizing dye, SD-9 | $1 \times 10^{-4}$ |
| Sensitizing dye, SD-10 | $3 \times 10^{-4}$ |
| Yellow coupler, Y-1 | 0.35 |
| Yellow coupler, Y-2 | 0.06 |
| High boiling solvent, Oil-3 | 0.18 |
| Gelatin | 0.5 |
| Layer 12: First protective layer (PRO-1) | |
| UV absorbent, UV-1 | 0.10 |
| UV absorbent, UV-2 | 0.05 |
| High boiling solvent, Oil-1 | 0.1 |
| High boiling solvent, Oil-4 | 1.0 |
| Gelatin | 1.0 |
| Layer 13: Second protective layer (PRO-2) | |
| Fine grain silver bromoiodide emulsion, an average grain size: 0.08μ and an AgI content: 2 mole % | 0.1 |
| Surfactant, SU-1 | 0.005 |
| Polymethyl methacrylate, an average grain size: 3 μm | 0.20 |
| Gelatin | 0.6 |

Besides the above-given components, coating aid SU-2, dispersing aid SU-3, hadeners H-1 and H-2, stabilizer ST-1, and antifoggants AF-1 and AF-2 were also added to each of the layers.

Em-1-(1): Monodispersed emulsion with a low AgI content of 2 mole % on a surface; a grain size distribution of 14%; an average grain size of 0.46 μm; and an average silver iodide content of 7.0 mole %

Em-2-(1): Monodispersed emulsion having silver bromide on a surface; a grain size distribution of 14%; an average grain size of 0.30 μm; and an average silver iodide content of 2.0 mole %.

Em-3-(1): Monodispersed emulsion with a low AgI content of 1.0 mole % on a surface; a grain size distribution of 14%; an average grain size of 0.81 μm; and an average silver iodide content of 7.0 mole %.

Em-4-(1)-Monodispersed emulsion with a low AgI content of 0.5 mole % on a surface; a grain size distribution of 14%; an average grain size of 0.95 μm; and an average silver iodide content of 8.0 mole %.

SD-1

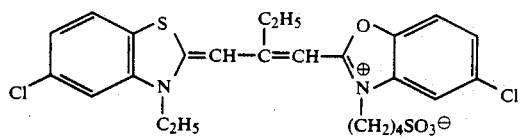

SD-2

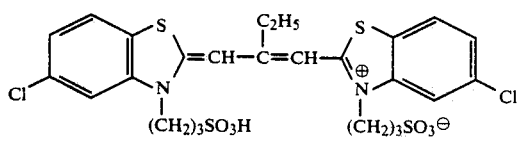

SD-3

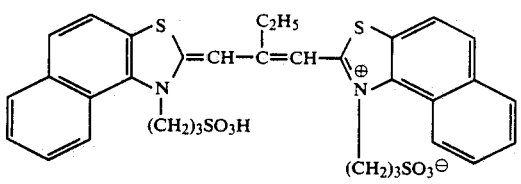

SD-4

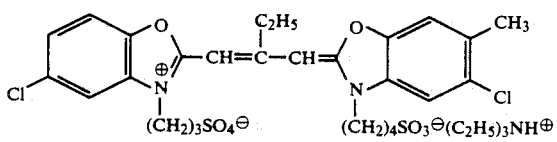

SD-5

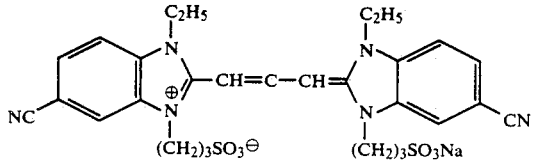

SD-6

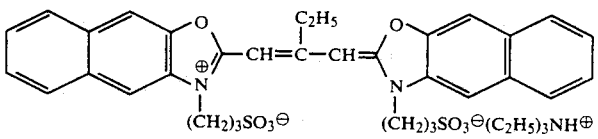

-continued
SD-7
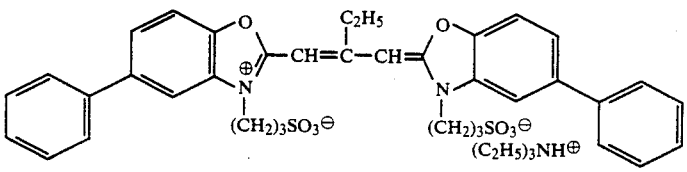
SD-8
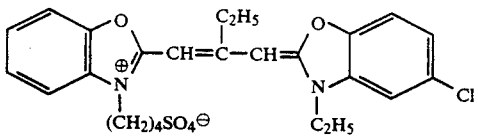
SD-9
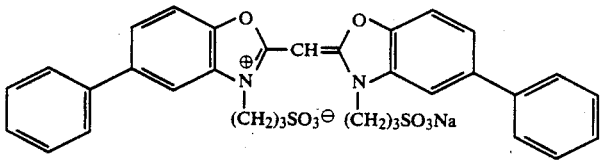
SD-10
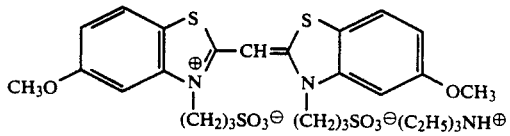
C-1
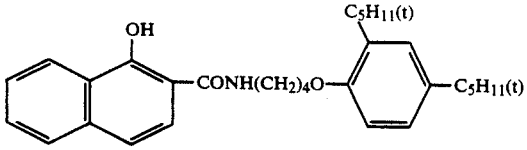
C-2
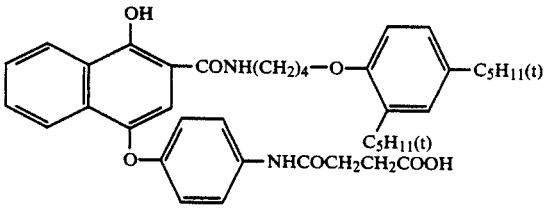
M-1
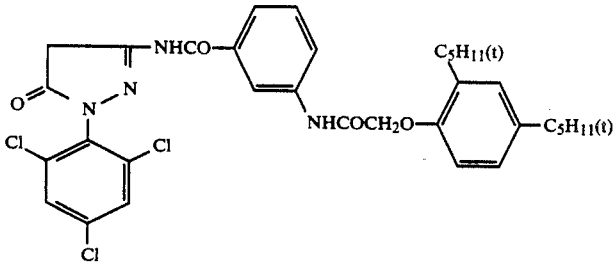
M-2
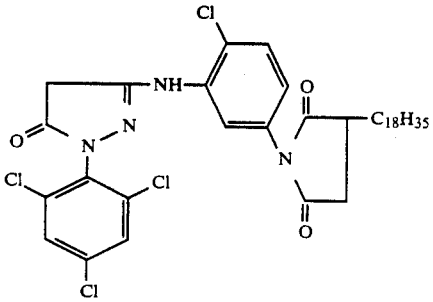

-continued
M-3
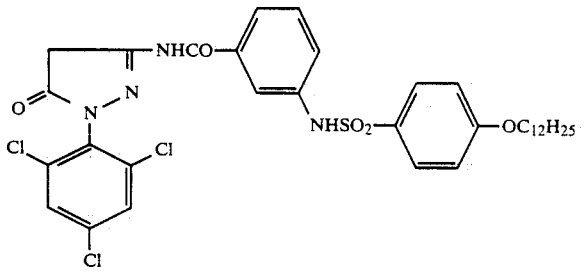
Y-1
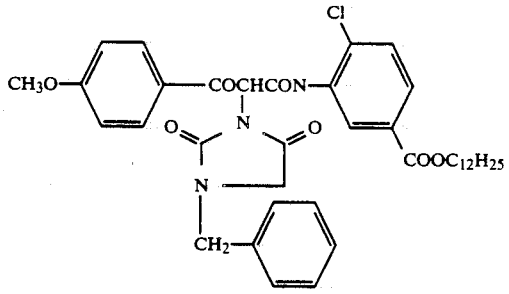
Y-2
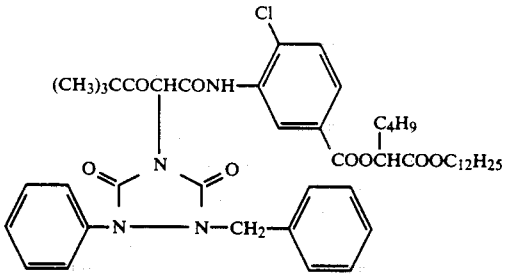
CC-1
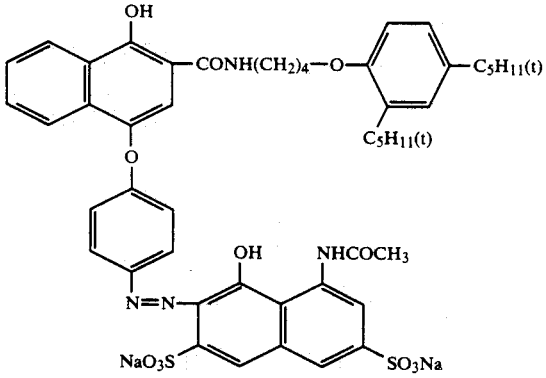
CM-1
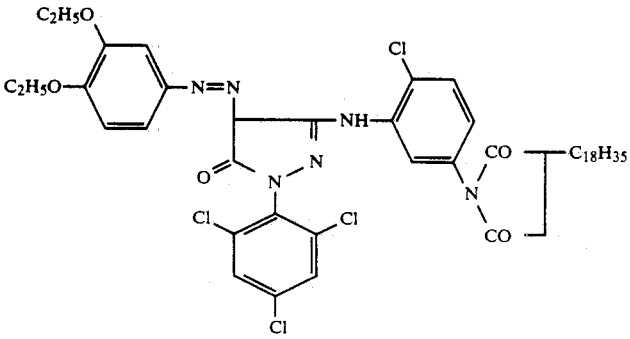

-continued
CM-1
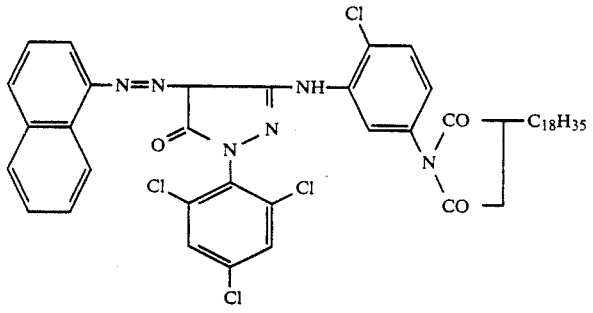
D-1
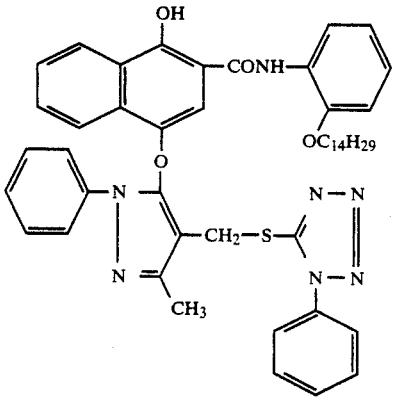
D-2
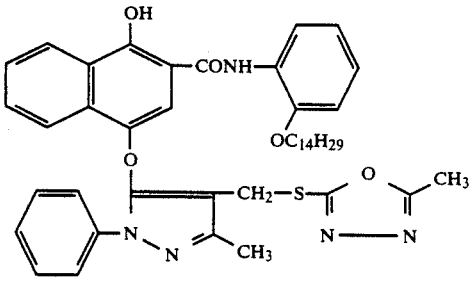
D-3
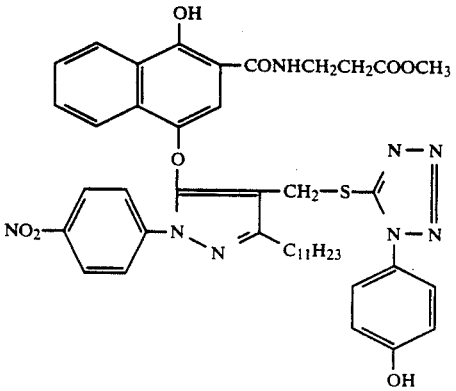

-continued
D-4
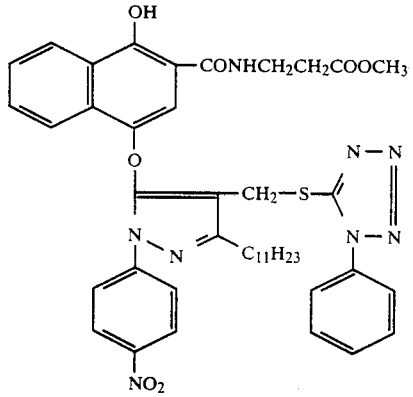
UV-1
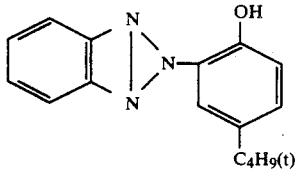
UV-2
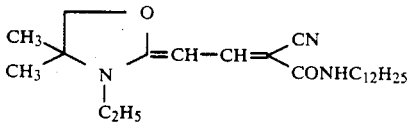
HS-1
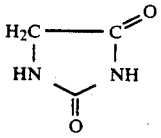
HS-2
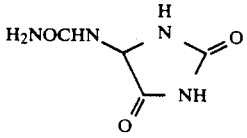
H-1
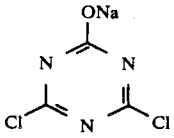
H-2
$[(CH_2{=}CHSO_2CH_2)_3CCH_2SO_2(CH_2)_2]_2N(CH_2)_2SO_3K$
Su-1
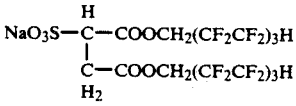
Su-2
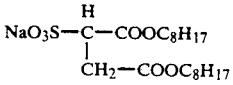
Su-3
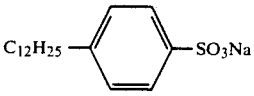

-continued

SC-1

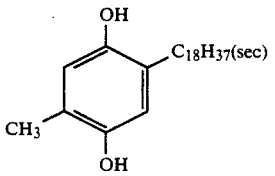

Oil-1

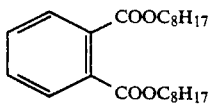

Oil-2

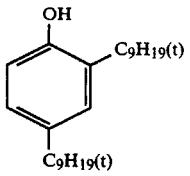

Oil-3

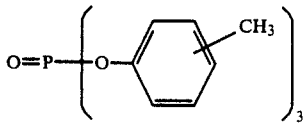

Oil-4

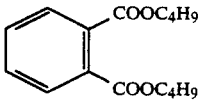

ST-1

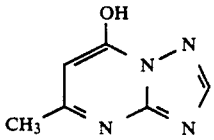

AF-1

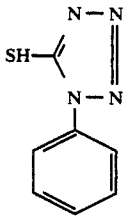

AF-2

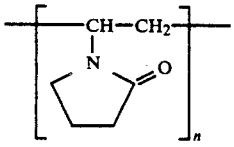

Samples 102 through 112 were prepared in the same manner as in Sample 101, except that the matting agents added to Layers 5, 9 and 13, and the total silver amounts were changed as shown in Table 1 by changing the silver amounts coated on Layers 3, 4, 6, 8, 10 and 11.

Two pieces each of $cm^2$ were cut out of Samples 101 and 102, and were left standing in an atmosphere of 23° C. and 80% RH for one day without contacting each other. Then, the protective layers of the samples were contacted each other with 800 g loaded thereto in an atmosphere of 40° C. and 80% RH. After that, the samples were pealed off and the contacted areas thereof were measured to evaluate an adhesion resistance.

Followings are rating standards.

Rank A: Adhered area 0 to 20%
Rank B: Adhered area 21 to 40%
Rank C: Adhered area 41 to 60%
Rank D: Adhered area 61 to 80%

Further, Samples 101 through 112 were subjected to exposure to white light through a wedge and a wedge for MTF (Modulation Transfer Function), and then to following processing.

| Processing step | (38° C.) |
|---|---|
| Color developing | 3 min. 15 sec. |
| Bleaching | 6 min. 30 sec. |
| Washing | 3 min. 15 sec. |
| Fixing | 6 min. 30 sec. |

-continued

| Processing step | (38° C.) |
|---|---|
| Washing | 3 min. 15 sec. |
| Stabilizing | 1 min. 30 sec. |
| Drying | |

In the respective processing stage, there are used the following compositions of the processing solutions;

| | |
|---|---|
| **Color developer:** | |
| 4-amino-3-methyl-N-ethyl-N-(β-hydroxyethyl)aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.3 g |
| Trisodium nitrilotriacetate monohydrate | 2.5 g |
| Potassium hydroxide | 1.0 g |
| Add water to make total quantity | 1 liter |
| **Bleaching solution:** | |
| Ferrous ammonium ethylenediamine-tetraacetate | 100 g |
| Diammonium ethylenediaminetetraacetate | 10.0 g |
| Ammonium bromide | 150.0 g |
| Glacial acetic acid | 10.0 ml |
| Add water to make total quantity | 1 liter |
| Adjust pH with aqueous ammonia to | 6.0 |
| **Fixing solution:** | |
| Ammonium thiosulfate | 175.0 g |
| Sodium sulfite anhydride | 8.5 g |
| Sodium metasulfite | 2.3 g |
| Add water to make total quantity | 1 liter |
| Adjust pH with acetic acid to | 6.0 |
| **Stabilizing solution:** | |
| Formalin (37% aqueous solution) | 1.5 ml |
| Konidux, manufactured by Konica Corp. | 7.5 ml |
| Add water to make total quantity | 1 liter |

With respect to each of the processed samples, sharpness (MTF) and RMS (graininess) were measured. MTF is a value relative to that of Sample 101 in 20 lines/mm, which is set at 100.

The RMS values were obtained conventionally by scanning a small area of a minimum density +1 with a micro densitometer having a scanning aperture of 250 $\mu m^2$ and measuring a variation of a density; RMS is a value relative to that of Sample 101, which is set at 100.

The results are shown in Table 1.

TABLE 1

| Sample No. | Matting agent Layer 5 | Layer 9 | Layer 13 | Total Ag amt. mg/dm² | Adhesion resistance | RMS | MTF |
|---|---|---|---|---|---|---|---|
| 101 Comp. | PMM* | PMM | PMM | 36 | C | 100 | 100 |
| 102 Inv. | PMM | PMM | Mat 3 | 36 | A | 110 | 110 |
| 103 Inv. | Mat 3 | PMM | Mat 3 | 36 | A | 112 | 115 |
| 104 Inv. | PMM | Mat 3 | Mat 3 | 36 | A | 115 | 120 |
| 105 Inv. | Mat 3 | Mat 3 | Mat 3 | 36 | A | 115 | 125 |
| 106 Inv. | Mat 1 | Mat 1 | Mat 1 | 36 | A | 113 | 130 |
| 107 Inv. | Mat 2 | Mat 2 | Mat 2 | 36 | A | 112 | 130 |
| 108 Inv. | Mat 4 | Mat 4 | Mat 4 | 36 | A | 110 | 120 |
| 109 Inv. | Mat 3 | Mat 3 | Mat 3 | 40 | A | 120 | 125 |
| 110 Inv. | Mat 3 | Mat 3 | Mat 3 | 20 | B | 100 | 110 |
| 111 Comp. | Mat 3 | Mat 3 | Mat 3 | 50 | B | 100 | 80 |
| 112 Comp. | Mat 3 | Mat 3 | Mat 3 | 10 | D | 75 | 70 |

*PMM = Polymethyl methacrylate

As is obvious from Table 1, the samples of the invention have an excellent adhesion resistance and exhibit no deterioration of image quality. A further excellent result can be obtained by incorporating an alkali soluble matting agent into an outermost layer of the multilayers.

Similarly, there were prepared and evaluated the samples in which the colored cyan couplers of Layers 3 and 4 in Sample No. 105 were replaced by CC-3 and CC-12, the colored magenta couplers of Layer 6 by CM-3 and CM-4, and the colored magenta couplers of Layer 8 by CM-5 to CM-12 to find that they have likewise an excellent adhesion resistance and exhibit no deterioration of image quality.

Further, the light-sensitive material of the invention was not badly affected even by processing with a supplementary amount of a color developer reduced from 900 ml to 400 ml per square meter of a light-sensitive material, and the differences in a gradation and a minimum density were very little.

EXAMPLE 2

Samples No. 201 through No. 210 were prepared by providing the photographic component layers having the following compositions on a cellulose triacetate film support provided with a subbing layer.

| | |
|---|---|
| **Layer 1: Antihalation layer** | |
| Black colloidal silver | 0.2 |
| Gelatin | 1.3 |
| UV-1 | 0.1 |
| Oil-1 | 0.01 |
| Oil-2 | 0.01 |
| **Layer 2: An interlayer** | |
| Gelatin | 1.0 |
| **Layer 3: First red-sensitive emulsion layer** | |
| Silver bromoiodide emulsion; amorphous grains having AgI of 2 mole %, average grain size of 0.3μ, and variation coefficient of 29% | 0.3 |
| Gelatin | 0.4 |
| SD-1 | $1.0 \times 10^{-4}$ |
| SD-2 | $3.0 \times 10^{-4}$ |
| SD-3 | $1 \times 10^{-5}$ |
| C-1 | 0.08 |
| C-2 | 0.08 |
| CC-1 | 0.01 |
| D-1 | 0.003 |
| Oil-1 | 0.03 |
| **Layer 4: Second red-sensitive emulsion layer** | |
| Silver bromoiodide emulsion; amorphous grains having AgI of 5 mole %, I type, average grain size of 0.7μ, and variation coefficient of 25%, | 0.4 |
| Gelatin | 0.6 |
| SD-1 | $1 \times 10^{-4}$ |
| SD-2 | $3 \times 10^{-4}$ |
| SD-3 | $1 \times 10^{-4}$ |
| C-1 | 0.20 |
| C-2 | 0.25 |
| CC-1 | 0.03 |
| D-1 | 0.01 |

-continued

| | |
|---|---|
| Oil-1 | 0.15 |
| **Layer 5: Third red-sensitive emulsion layer** | |
| Silver bromoiodide emulsion; amorphous grains having AgI of 10 mole %, average grain size of 0.8μ, and variation coefficient of 16%, | 0.7 |
| Gelatin | 0.8 |
| SD-1 | $1 \times 10^{-4}$ |
| SD-2 | $3 \times 10^{-4}$ |
| SD-3 | $1 \times 10^{-5}$ |
| C-1 | 0.4 |
| C-2 | 0.8 |
| CC-1 | 0.1 |
| Oil-1 | 0.01 |
| D-1 | 0.05 |
| **Layer 6: Interlayer** | |
| Gelatin | 1.0 |
| SC-1 | 0.03 |
| Oil-1 | 0.05 |
| **Layer 7: First green-sensitive emulsion layer** | |
| Silver bromoiodide emulsion; amorphous grains having AgI of 2 mole %, average grain size of 0.3μ, and variation coefficient of 28%, | 0.2 |
| SD-4 | $5 \times 10^{-4}$ |
| SD-5 | $2 \times 10^{-4}$ |
| SD-6 | $0.3 \times 10^{-4}$ |
| Gelatin | 0.8 |
| M-1 | 0.16 |
| D-3 | 0.005 |
| CM-1 | 0.01 |
| Oil-1 | 0.5 |
| **Layer 8: Second green-sensitive emulsion layer** | |
| Silver bromoiodide emulsion; amorphous grains having AgI of 4 mole %, average grain size of 0.6μ, and variation coefficient of 38%, | 0.3 |
| Gelatin | 0.8 |
| SD-4 | $5 \times 10^{-4}$ |
| SD-5 | $2 \times 10^{-4}$ |
| SD-6 | $0.3 \times 10^{-4}$ |
| M-1 | 0.20 |
| D-3 | 0.02 |
| CM-1 | 0.04 |
| Oil-1 | 0.2 |
| **Layer 9: Third green-sensitive emulsion layer** | |
| Silver bromoiodide emulsion; amorphous grains having AgI of 6 mole %, average grain size of 1.0μ, and variation coefficient of 80%, | 0.6 |
| Gelatin | 0.8 |
| SD-7 | $3.5 \times 10^{-4}$ |
| SD-8 | $1.4 \times 10^{-4}$ |
| M-3 | 0.15 |
| M-2 | 0.05 |
| D-4 | 0.01 |
| Oil-3 | 0.20 |
| **Layer 10: Yellow filter layer** | |
| Gelatin | 1.2 |
| Yellow colloidal silver | 0.08 |
| SC-1 | 0.1 |
| Oil-3 | 0.3 |
| **Layer 11: First blue-sensitive emulsion layer** | |
| Silver bromoiodide emulsion; amorphous grains having AgI of 4 mole %, average grain size of 0.5μ, and variation coefficient of 15%, | 0.2 |
| Gelatin | 0.8 |
| SD-9 | $2 \times 10^{-4}$ |
| SD-10 | $5 \times 10^{-5}$ |
| Y-1 | 0.6 |
| Y-2 | 0.15 |
| D-2 | 0.005 |
| Oil-3 | 0.20 |
| **Layer 12: Second blue-sensitive emulsion layer** | |
| Silver bromoiodide emulsion: amorphous grains having AgI of 10 mole %, average grain size of 1.3μ, and variation coefficient of 25%, | 0.3 |
| Gelatin | 0.5 |
| SD-9 | $1 \times 10^{-4}$ |
| SD-10 | $5 \times 10^{-5}$ |
| Y-1 | 0.20 |
| Oil-3 | 0.06 |
| **Layer 13: First protective layer** | |
| Gelatin | 0.8 |
| UV-1 | 0.1 |
| UV-2 | 0.2 |
| Oil-1 | 0.01 |
| Oil-2 | 0.01 |
| **Layer 14: Second protective layer** | |
| Silver bromide: fine grains having average grain size of 0.07μ | 0.1 |
| Gelatin | 0.45 |
| Polymethyl methacrylate: a diameter: 3.0μ | 0.2 |
| H-1 | 0.4 |

Besides the above-given compositions, surfactants were further added as a coating aid.

Samples No. 202 through 210 were prepared in the same manner as in Sample No. 201, except that the matting agents of Layer 14 and the total silver amounts were changed as shown in Table 2 by changing the silver amounts coated on Layers 3, 4, 5, 7, 8, 9, 11 and 12.

The evaluations were carried out in the same manner as in Example 1, and the results are shown in Table 2.

TABLE 2

| Sample No | Matting agent for Layer 14 | Total Ag amount mg/dm$^2$ | Adhesion resistance | RMS | MTF |
|---|---|---|---|---|---|
| 201 Comp. | PMM* | 34 | C | 100 | 100 |
| 202 Inv. | Mat 1 | 34 | A | 113 | 125 |
| 203 Inv. | Mat 2 | 34 | A | 115 | 125 |
| 204 Inv. | Mat 3 | 34 | A | 115 | 125 |
| 205 Inv. | Mat 4 | 34 | A | 110 | 120 |
| 206 Inv. | Mat 3 | 40 | A | 118 | 125 |
| 207 Inv. | Mat 3 | 25 | A | 105 | 115 |
| 208 Inv. | Mat 3 | 20 | B | 102 | 110 |
| 209 Comp. | Mat 3 | 10 | D | 80 | 70 |
| 210 Comp. | Mat 3 | 50 | B | 100 | 80 |

*PMM = Polymethyl methacrylate

As is obvious from Table 2, the samples of the invention have an excellent adhesion resistance and exhibit no deterioration of image quality.

Even in the samples in which the colored cyan couplers of Layers 3, 4 and 5 of Sample No. 204 of the invention are replaced by CC-3 and CC-12, the colored magenta couplers of Layer 7 by CM-3 and CM-4, and the colored magenta couplers of Layers 8 and 9 by CM-2 and CM-5 to CM-12, they had also an excellent adhesion resistance and exhibited no deterioration of image quality.

Further, the light-sensitive material of the invention was not badly affected even by processing with a supplementary amount of a color developer reduced from 900 ml to 400 ml per square meter of a light-sensitive material, and the differences in a gradation and a minimum density were very little.

ADVANTAGES OF THE INVENTION

The silver halide color photographic light-sensitive materials of the invention have been improved in an adhesion resistance to a large extent without deteriorating image quality in spite of a low silver content.

Further, even processing with a processing solution in a reduced supplementary amount has not badly affected the light-sensitive material of the invention without causing deterioration of the properties.

Such remarkable reduction of a coated silver amount will contribute to saving of resources, and a lower replenishment to prevention of public pollutions.

What is claimed is:

1. A silver halide color photographic light-sensitive material having a support and photographic component layers thereon, said layers including at least one red-sensitive layer comprising at least a masking cyan coupler, a green-sensitive layer comprising at least a masking magenta coupler, and a blue-sensitive layer, wherein said light-sensitive material is characterized in that:

A. an uppermost layer of said photographic component layers comprises an alkali-soluble matting agent, B. a total amount of coated silver is 15 to 45 mg/dm$^2$, wherein said alkali-soluble matting agent is:

a. a copolymer of an alkyl methacrylate and a methacrylic acid, acrylic acid, or itaconic acid, b. a copolymer of an alkyl methacrylate and a maleic monoester and a maleic monoamide, c. a copolymer of styrene with an $\alpha$, $\beta$ unsaturated mono- or dicarboxylic acid, a dicarboxylic monoester, or dicarboxylic monoamide, d. a graft polymer of maleic anhydride/ -olefin copolymer and methacrylic acid or methyl methacrylate, or e. a dicarboxylic acid monoester of a cellulose derivative.

2. The light-sensitive material of claim 1, wherein said alkali-soluble matting agent is soluble in a solution having pH of not lower than 7.0, and insoluble in a solution having pH of not higher than 5.0.

3. The light-sensitive material of claim 1, wherein said uppermost layer comprising the alkali-soluble matting agent is provided on the same side of the support as the light-sensitive layers.

4. The light-sensitive material of claim 3, wherein a particle size of said alkali-soluble matting agent is 0.5 to 10 $\mu$m.

5. The light-sensitive material of claim 4, wherein said particle size is 1 to 6 $\mu$m.

6. The light-sensitive material of claim 5, wherein an addition ratio of said alkali-soluble matting agent is 10 to 500 mg per square meter of the light-sensitive material.

7. The light-sensitive material of claim 6, wherein said addition ratio is 20 to 300 mg per square meter of the light-sensitive material.

8. The light-sensitive material of claim 1, wherein said total amount of coated silver is 20 to 40 mg/dm$^2$.

9. The light-sensitive material of claim 1, wherein said masking cyan coupler is a colored cyan coupler represented by Formula (A):

Formula (A)

$$\mathrm{COUP}^{*}-(J)_m-N=N-R_5$$

wherein COUP represents a cyan coupler residue; * represents a coupling site of a cyan coupler; J represents a divalent linkage group; m represents 0 or 1; and $R_5$ represents an aryl group.

10. The light-sensitive material of claim 9, wherein said COUP represents a phenol type or naphthol type cyan coupler residue.

11. The light-sensitive material of claim 10, wherein said COUP represents a naphthol type cyan coupler residue.

12. The light-sensitive material of claim 1, wherein said masking magenta coupler is a colored magenta coupler represented by Formula (III):

Formula (III)

$$Cp-N=N-R_1$$

wherein Cp represents a magenta coupler residue, provided that an azo group is bonded to an active site of the magenta coupler; $R_1$ represents an aryl group.

13. The light-sensitive material of claim 9, wherein a ratio of said colored cyan coupler to total cyan couplers is 5 to 95 mol %.

14. The light-sensitive material of claim 12, wherein a ratio of said colored magenta coupler to total magenta couplers is 5 to 95 mol %.

* * * * *